US010804062B2

(12) United States Patent
Jeong

(10) Patent No.: US 10,804,062 B2
(45) Date of Patent: Oct. 13, 2020

(54) FIELD EMISSION DEVICE

(71) Applicant: ELECTRONICS AND TELECOMMUNICATIONS RESEARCH INSTITUTE, Daejeon (KR)

(72) Inventor: Jin-Woo Jeong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 16/777,547

(22) Filed: Jan. 30, 2020

(65) Prior Publication Data

US 2020/0251299 A1 Aug. 6, 2020

(30) Foreign Application Priority Data

Jan. 31, 2019 (KR) ..... 10-2019-0013152
Jan. 9, 2020 (KR) ..... 10-2020-0003141

(51) Int. Cl.
*H01J 9/02* (2006.01)
*H01J 1/304* (2006.01)

(52) U.S. Cl.
CPC ..... *H01J 9/025* (2013.01); *H01J 1/304* (2013.01); *H01J 2201/30469* (2013.01); *H01J 2235/086* (2013.01)

(58) Field of Classification Search
None
See application file for complete search history.

(56) References Cited

U.S. PATENT DOCUMENTS 4,728,851 A * 3/1988 Lambe ..... H01J 3/021 313/309
6,020,677 A * 2/2000 Blanchet-Fincher ... H01J 1/304 313/309
7,745,984 B2 * 6/2010 Lee ..... H01J 1/3048 313/497
7,750,550 B2 7/2010 Kim et al.
8,193,692 B2 6/2012 Lee et al.
8,384,630 B2 * 2/2013 Ray ..... H01L 51/447 345/82
8,989,351 B2 3/2015 Vogtmeier et al.
2011/0204123 A1 * 8/2011 Dong ..... H01L 21/02068 228/203
2018/0068768 A1 3/2018 Kim et al.
2018/0211806 A1 7/2018 Jeong et al.

FOREIGN PATENT DOCUMENTS

JP 4408891 B2 2/2010
KR 1020060111333 A 10/2006
KR 101082678 B1 11/2011

* cited by examiner

*Primary Examiner* — Ashok Patel
(74) *Attorney, Agent, or Firm* — Rabin & Berdo, P.C.

(57) ABSTRACT

Provided is a field emission device. The field emission device includes a cathode electrode having a first surface and a second surface facing the first surface, the cathode electrode including grooves that are recessed from the first surface toward the second surface, the grooves extending in a first direction parallel to the first surface and emitter structures which are disposed within the grooves and each of which includes a core extending in the first direction and a conductive wire configured to surround the core. The grooves may be arranged in a second direction crossing the first direction, and the emitter structures may be disposed at vertical levels different from each other.

17 Claims, 12 Drawing Sheets

FIELD EMISSION DEVICE

CROSS-REFERENCE TO RELATED APPLICATIONS

This U.S. non-provisional patent application claims priority under 35 U.S.C. § 119 of Korean Patent Application Nos. 10-2019-0013152, filed on Jan. 31, 2019, and 10-2020-0003141, filed on Jan. 9, 2020, the entire contents of which are hereby incorporated by reference.

BACKGROUND

The present disclosure herein relates to a field emission device, and more particularly, to a field emission device including a cathode electrode and an emitter structure, which are electrically connected to each other.

Nanomaterials used as emitters may emit electrons to the outside of nanomaterials through a quantum tunneling effect caused by external electric fields. For the effective occurrence of the electron emission process, the tip of the emitter has to have a sharp shape. Therefore, nanomaterials, each of which has a thin and long shape, are widely used as emitters of a field emission device. For example, nanomaterials such as carbon nanotubes (CNT) may be used as the emitters of the field emission device. In the case in which the tip of each of the emitters has the sharp shape, electric fields may be concentrated into the tips of the emitters to improve the electron emission efficiency.

Recently, as the field emission device requiring high-current emitter characteristics such as X-ray tubes are widely used throughout the industry, studies on an emitter, which has an advantageous structure for field emission, is easy to be manufactured, and has excellent durability, and a field emission device including the same are being actively conducted.

SUMMARY

The present disclosure provides an emitter structure, which has an advantageous structure for field emission, is easy to be manufactured, and has excellent durability, and a field emission device including the same.

The object of the present disclosure is not limited to the aforesaid, but other objects not described herein will be clearly understood by those skilled in the art from descriptions below.

An embodiment of the inventive concept provides a field emission device including: a cathode electrode having a first surface and a second surface facing the first surface, the cathode electrode including grooves that are recessed from the first surface toward the second surface, the grooves extending in a first direction parallel to the first surface; and emitter structures which are disposed within the grooves and each of which includes a core extending in the first direction and a conductive wire configured to surround the core, wherein the grooves are arranged in a second direction crossing the first direction, and the emitter structures are disposed at vertical levels different from each other.

In an embodiment, the first surface of the cathode electrode may include a concave region that is recessed toward the second surface, and the grooves may be defined in the concave region.

In an embodiment, the concave region may have a constant height along the first direction.

In an embodiment, the grooves may include a first groove and a second groove, spaced apart from each other in a second direction perpendicular to the first direction, and a bottom surface of the first groove may be inclined with respect to a bottom surface of the second groove.

In an embodiment, each of the emitter structures may have a diameter less than a depth of each of the grooves.

In an embodiment, the field emission device may further include a target including a third surface facing the first surface and inclined with respect to the first surface.

In an embodiment, the third surface may be parallel to the second direction.

In an embodiment, the conductive wire may include a plurality of strings, and the strings may have ends protruding in a direction that is away from the second surface.

In an embodiment, the ends of the strings may extend in a direction perpendicular to the first direction.

In an embodiment, the conductive wire may include a plurality of strings coupled to each other.

In an embodiment, the conductive wire may include a carbon nanotube.

In an embodiment, the field emission device may further include a target on the first surface and a gate structure between the cathode electrode and the target, wherein the gate structure may include a plurality of conductive rods extending in the first direction.

In an embodiment of the inventive concept, a field emission device includes: a cathode electrode having a first surface and a second surface facing the first surface, the cathode electrode including grooves that are recessed from the first surface toward the second surface, wherein the grooves extend in a first direction; an emitter structure disposed within each of the grooves; and a target comprising a third surface facing the first surface, wherein the emitter structure includes a core extending in the first direction and a conductive wire configured to surround the core, and the conductive wire includes strings having ends protruding toward the target.

In an embodiment, the strings may include carbon nanotubes.

In an embodiment, each of the ends may be disposed at a level lower than the uppermost portion of an inner wall of each of the grooves.

In an embodiment, the ends of the strings may extend in a second direction perpendicular to the first direction.

In an embodiment, the field emission device may further include a gate structure disposed between the target and the cathode electrode and having an opening extending in the first direction.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
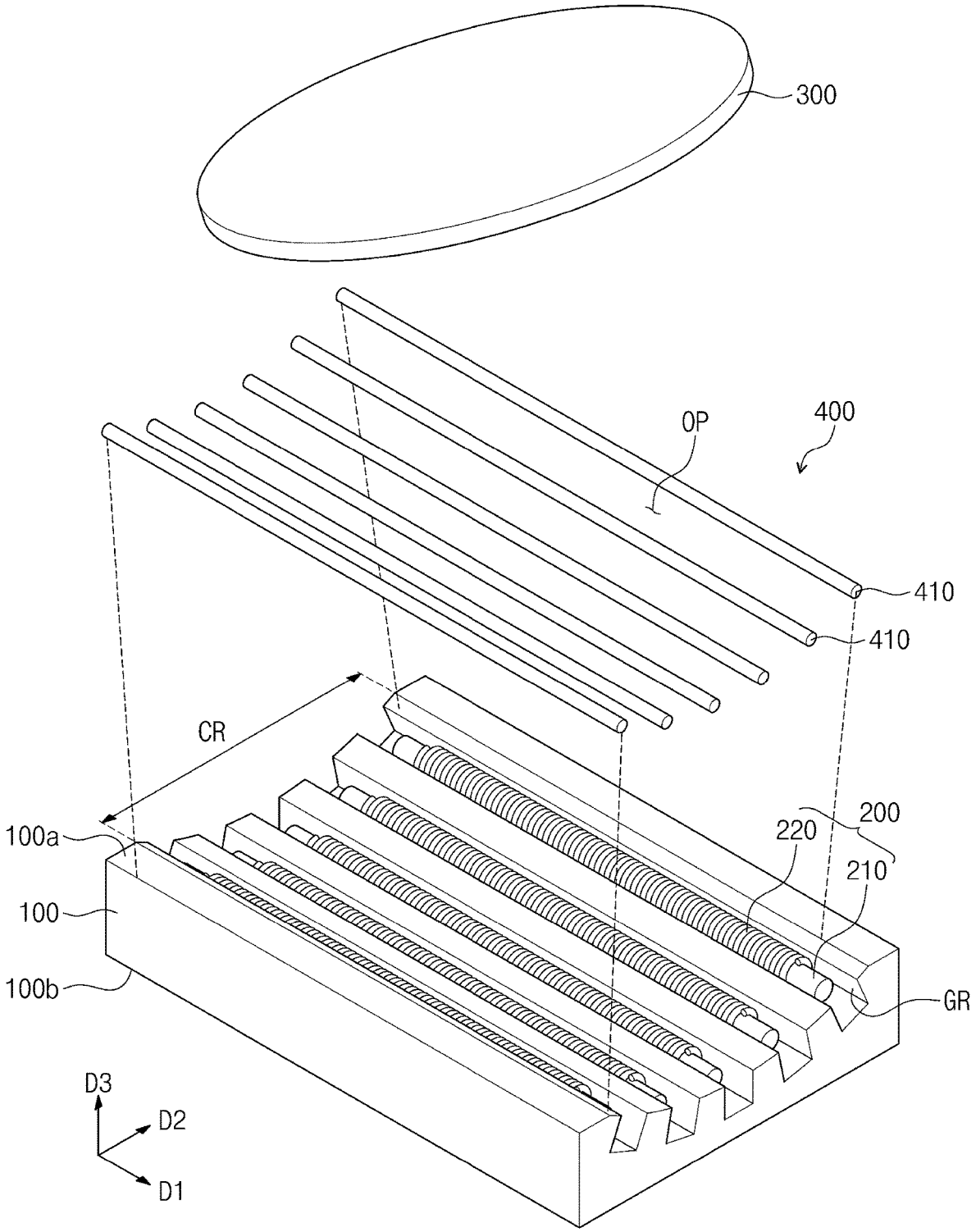
FIG. 1 is a schematic perspective view of a field emission device according to embodiments of the inventive concept.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. Like reference numerals refer to like elements throughout.

In the following description, the technical terms are used only for explaining a specific exemplary embodiment while not limiting the present invention. In this specification, the terms of a singular form may include plural forms unless specifically mentioned. The meaning of 'comprises' and/or 'comprising' specifies a component, a step, an operation and/or an element does not exclude other components, steps, operations and/or elements.

Additionally, the embodiment in the detailed description will be described with sectional views as ideal exemplary views of the present invention. In the figures, the dimensions of layers and regions are exaggerated for clarity of illustration. Accordingly, shapes of the exemplary views may be modified according to manufacturing techniques and/or allowable errors. Therefore, the embodiments of the present invention are not limited to the specific shape illustrated in the exemplary views, but may include other shapes that may be created according to manufacturing processes. For example, an etched region illustrated as a rectangle may be rounded or have a shape with a predetermine curvature. Regions exemplified in the drawings have general properties and are used to illustrate a specific shape of a device. Thus, this should not be construed as limited to the scope of the inventive concept.

Hereinafter embodiments of the inventive concept will be in detail with reference to the accompanying drawings.

FIG. 1 is a schematic perspective view of a field emission device according to embodiments of the inventive concept.

Referring to FIG. 1, a field emission device according to embodiments of the present invention may include a cathode electrode 100, an emitter structure 200, a gate structure 400, and a target 300. According to embodiments, the field emission device may be an X-ray source that emits X-rays using an electron beam.

The cathode electrode 100 and the emitter structure 200 may be electron sources that are electrically connected to each other. The cathode electrode 100 may include a first surface 100*a* and a second surface 100*b* facing the first surface 100*a*. The cathode electrode 100 may include grooves GR that are recessed from the first surface 100*a* toward the second surface 100*b*. The grooves GR may extend in a first direction D1 and be arranged along a second direction D2. The grooves GR may be disposed at different vertical levels from the second surface 100*b* of the cathode electrode 100. The cathode electrode 100 may include a concave region CR recessed from the first surface 100*a* toward the second surface 100*b*. The grooves GR may be defined in the concave region CR.

The emitter structures 200 may be disposed in the grooves GR. The emitter structures 200 may be disposed in the grooves GR arranged in the second direction D2. The emitter structures 200 may contact inner surfaces of the grooves GR so as to be electrically connected to the cathode electrode 100. Each of the emitter structures 200 may include a core 210 extending in the first direction D1 and a conductive wire 220 surrounding the core 210. Each of the core 210 and the conductive wire 220 may include a conductive material. The conductive wire 220 may include, for example, a carbon nanotube.

The target 300 may be disposed on the first surface 100*a* of the cathode electrode 100. The target 300 may receive an electron beam b1 from the cathode electrode 100 and the emitter structures 200 to output X-rays. For example, the target 300 may be a reflective target that is inclined with respect to the cathode electrode 100. In other words, the field emission device according to embodiments of the present invention may be a reflective field emission device.

The gate structure 400 may be disposed between the cathode electrode 100 and the target 300. An electric field may be generated between the gate structure 400 and the cathode electrode 100, and the electron beam may be emitted from the emitter structure 200. The gate structure 400 may focus the electron beam emitted from the emitter structure 200 onto the surface of the target 300.

Figure 2:
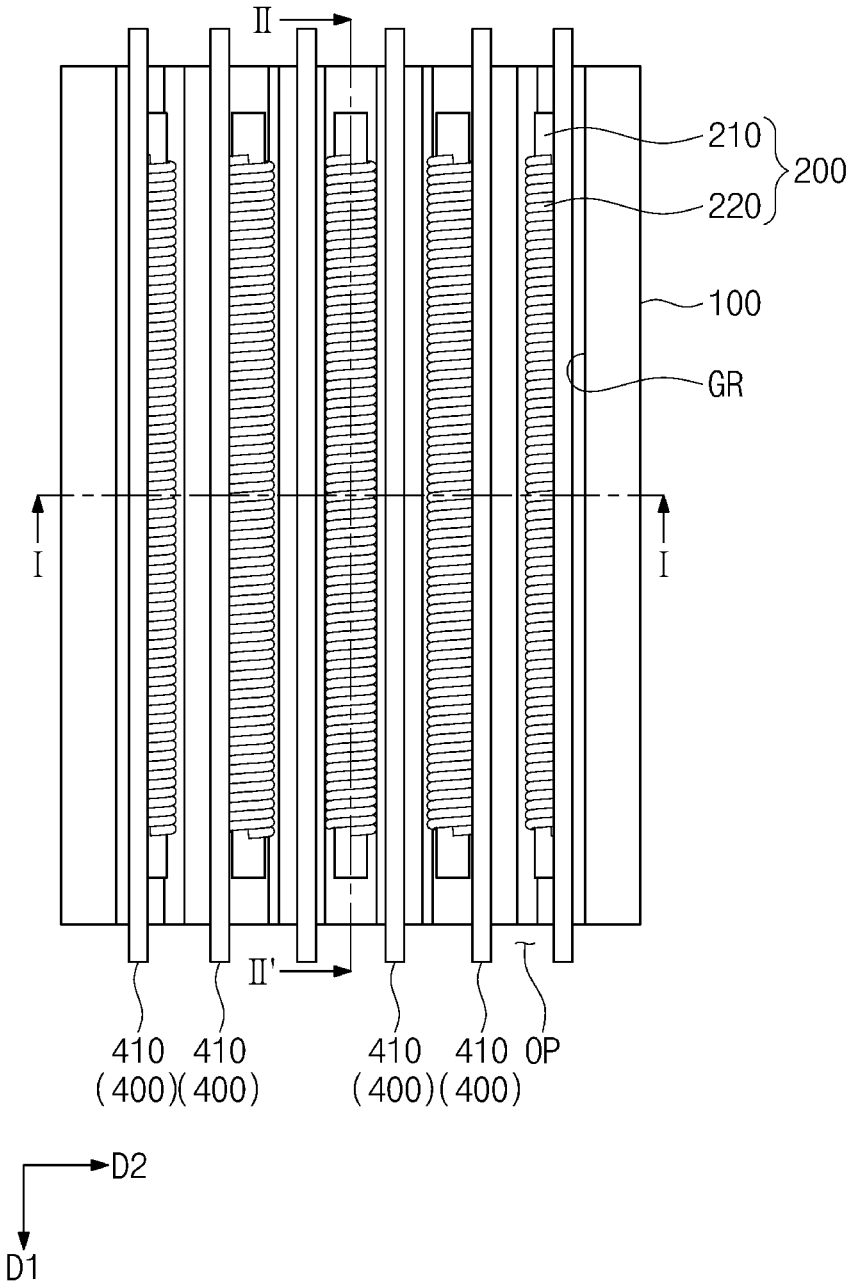
FIG. 2 is a plan view of the field emission device according to embodiments of the inventive concept.
Figure 3:
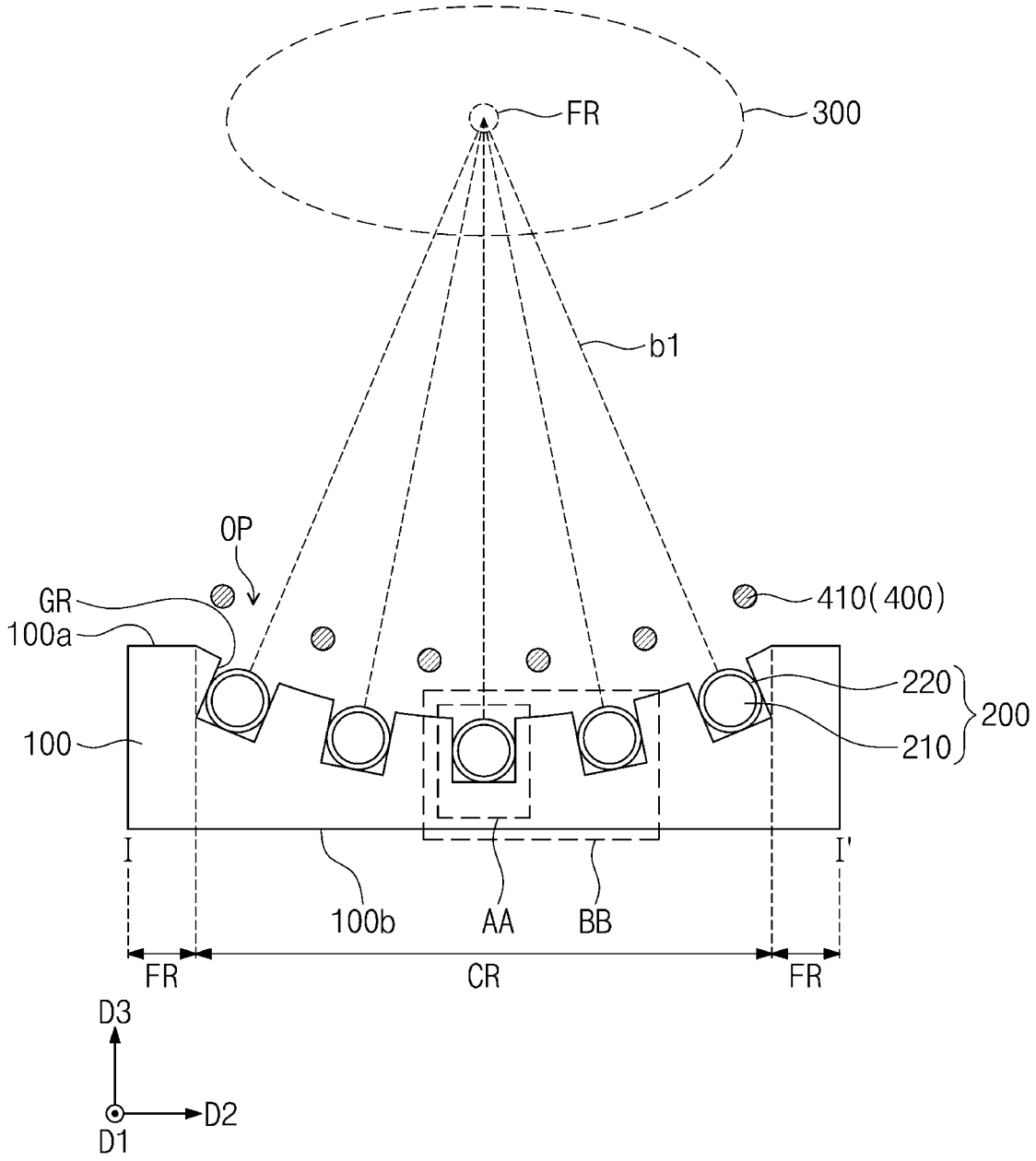
FIGS. 3 and 4 are cross-sectional views taken along lines I-I' and II-II' of FIG. 2, respectively.
Figure 4:
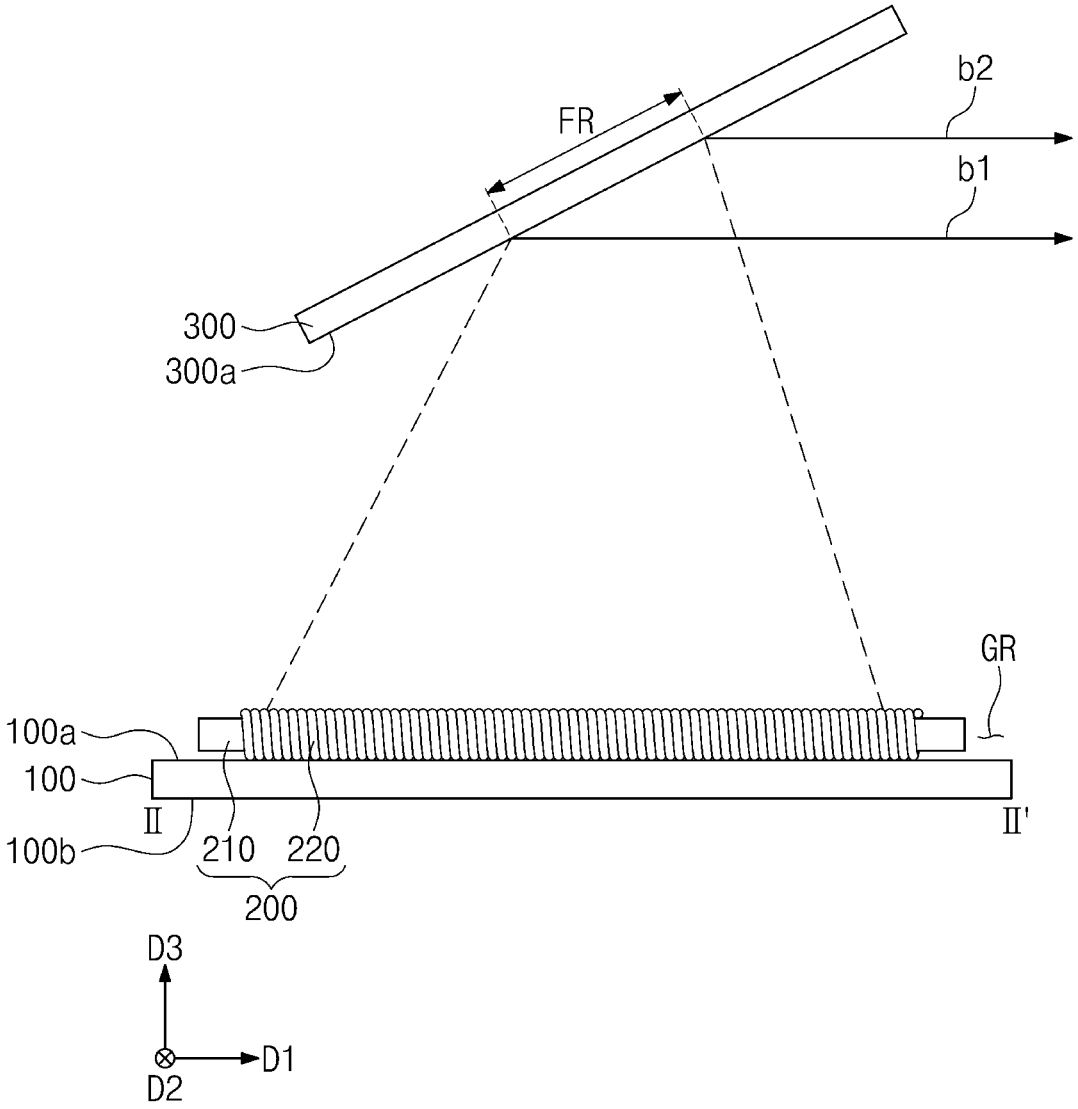
Figure 5:
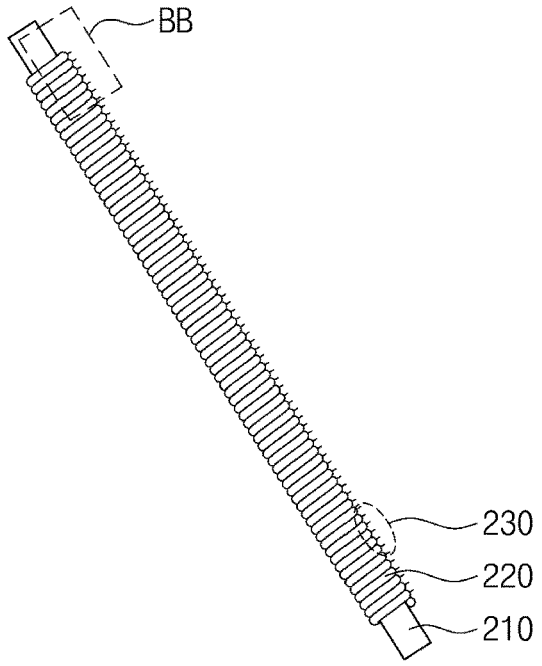
FIG. 5 is a perspective view of an emitter structure according to embodiments of the inventive concept.
Figure 6:
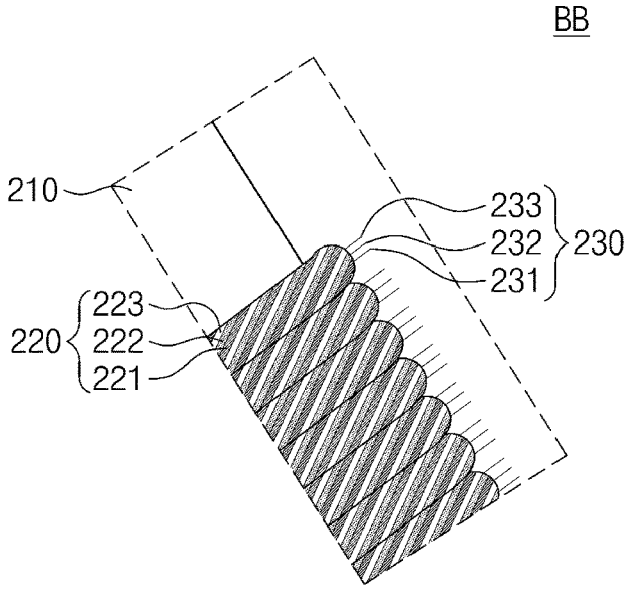
FIG. 6 is an enlarged cross-sectional view of a portion BB of FIG. 5.

FIG. 2 is a plan view of the field emission device according to embodiments of the inventive concept. FIGS. 3 and 4 are cross-sectional views taken along lines I-I' and II-II' of FIG. 2, respectively. FIG. 5 is a perspective view of the emitter structure according to embodiments of the inventive concept. FIG. 6 is an enlarged cross-sectional view of a portion BB of FIG. 5.

Referring to FIGS. 2 to 4, the cathode electrode 100 may have the first surface 100*a* and the second surface 100*b*, which face each other in a third direction D3. The first surface 100*a* of the cathode electrode 100 may include flat regions FR and the concave region CR between the flat regions FR. The flat regions FR may be disposed at edges of the first surface 100*a* and be parallel to the second surface 100*b*.

The concave region CR may have a recessed shape along the second surface 100*b*. The concave region CR may have a predetermined curvature so that the emitter structures 200 arranged along the second direction D2 are disposed in an arc shape. The vertical level of the concave region CR may be lowered away from the flat regions FR.

The concave region CR may have a constant vertical level along the first direction D1. For example, as illustrated in FIG. 4, the concave region CR may have a constant vertical level when viewed from a cross section taken along the cathode electrode 100 in the first direction D1. The concave region CR may have vertical levels different along the second direction D2. For example, as illustrated in FIG. 3, the uppermost surface of the first surface 100*a* may be flat, and the concave region CR recessed from the uppermost surface toward the second surface 100*b* may be changed in vertical levels different along the second direction D2. For example, the concave region CR may have the lowest vertical level at a central portion of the cathode electrode 100 in the second direction D2. As the concave region CR is defined in the first surface 100*a*, a distance between the first surface 100*a* and the second surface 100*b* may vary along the second direction D2. The cathode electrode 100 may include a metal and provide external power to the emitter structures 200.

The grooves GR of the cathode electrode 100 may be defined in the concave region CR of the first surface 100*a*. Each of the grooves GR may have a shape recessed from the first surface 100*a* toward the second surface 100*b*. In the plan view, the grooves GR may extend in the first direction D1 and be arranged in a second direction D2 crossing the first direction D1. The grooves GR may be disposed at vertical levels different from each other. For example, the groove GR defined in the central portion of the concave region CR in the second direction D2 may have a vertical level lower than the grooves GR defined in an edge portion. The grooves GR may be defined in a curve having a curvature center of a focus region FR disposed on a surface of the target 300.

The emitter structures 200 may be disposed in the grooves GR, respectively. Each of the emitter structures 200 may extend in the first direction D1, and the emitter structures 200 may be arranged in the second direction D2 crossing the first direction D1. The emitter structures 200 may be parallel to each other. Also, each of the emitter structures 200 may be parallel to the first surface 100*a* and the second surface 100*b* of the cathode electrode 100. As the grooves GR are disposed at vertical levels different from each other, the emitter structures 200 may be disposed at vertical levels different from each other. The emitter structures 200 may be arranged in an arc shape. For example, the emitter structures 200 may be disposed on the curve having the curvature center of the focus region FR disposed on the surface of the target 300. Accordingly, the electron beam b1 generated from the emitter structures 200 may be focused in the second direction D2 and may not be focused in the first direction D1.

The target 300 may be disposed on the first surface 100*a* of the cathode electrode 100 and have a third surface 300*a* facing the first surface 100*a*. The third surface 300*a* of the target 300 may receive the electron beam b1 from the cathode electrode 100 to generate an electromagnetic wave b2. The third surface 300*a* may be inclined at an angle with respect to the emitter structures 200, and the electromagnetic wave b2 may travel in the first direction D1. In detail, the third surface 300*a* may be parallel to the second direction D2 that is a direction, in which the emitter structures 200 are arranged, and the first direction 300 that is a direction, in which the emitter structures 200 extend. As a result, a line width of the electromagnetic wave b2 traveling in the first direction D1 may be reduced. The electromagnetic wave b2 may be, for example, X-rays. The focus region FR in which the electron beam b1 is focused may be defined on the third surface 100*a* of the target 300. The focus region FR may extend in the first direction D1 as illustrated in FIG. 4.

Referring to FIGS. 5 and 6, the emitter structure 200 may include a core 210 extending in one direction and a conductive wire 220 surrounding the core. The core 210 may include a metal. The conductive wire 220 may include a plurality of strings 221, 222, and 223. For example, the conductive wire 220 may include first to third strings 221, 222, and 223 coupled to each other. Each of the first to third strings 221, 222, and 223 may include a conductive material. The conductive material may be, for example, a carbon nanotube. The first to third strings 221, 222, and 223 may have first to third ends 231, 232, and 233 protruding in a direction that is away from the core 210, respectively. The first to third ends 231, 232, and 233 may extend side by side. For example, the first to third ends 231, 232, and 233 may extend in a direction perpendicular to the direction in which the core 210 extends.

Figure 7:
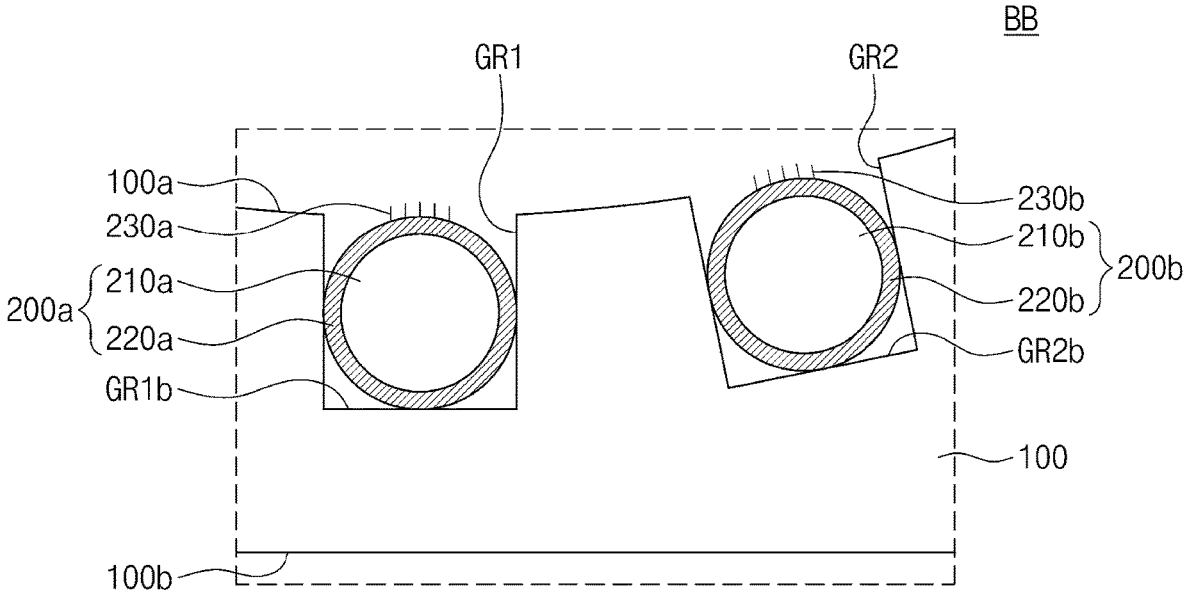
FIG. 7 is an enlarged cross-sectional view of a portion BB of FIG. 3.

FIG. 7 is an enlarged cross-sectional view of a portion BB of FIG. 3.

Referring to FIG. 7, the cathode electrode 100 may include a first groove 200*a* and a second groove GR2, which are arranged in the second direction D2. The first groove GR1 and the second groove GR2 may be disposed at vertical levels different from each other. For example, the first groove GR1 and the second groove GR2 have the same depth, but a bottom surface GRb of the first groove GR1 may be disposed at a level lower than a bottom surface GR2*b* of the second groove GR2.

The first emitter structure 200*a* may be disposed in the first groove GR1, and the second emitter structure 200*b* may be disposed in the second groove GR2. The first emitter structure 200*a* and the second emitter structure 200*b* may be disposed at vertical levels different from each other.

In detail, the first emitter structure 200*a* may include a first core 210*a* and a first conductive wire 220*a* surrounding the first core 210*a*. The first conductive wire 220*a* may include a plurality of strings, and first ends 230*a* of the plurality of strings may extend in a direction that is away from the first core 210*a*. The second emitter structure 200*b* may include a second core 210*b* and a second conductive wire 220*b* surrounding the second core 210*b*. The second conductive wire 220*b* may include a plurality of strings, and second ends 230*b* of the plurality of strings may extend in a direction that is away from the second core 210*b*. The first ends 230*a* may extend side by side in one direction. The second ends 230*b* may extend side by side in another direction crossing the one direction.

Figure 8A:
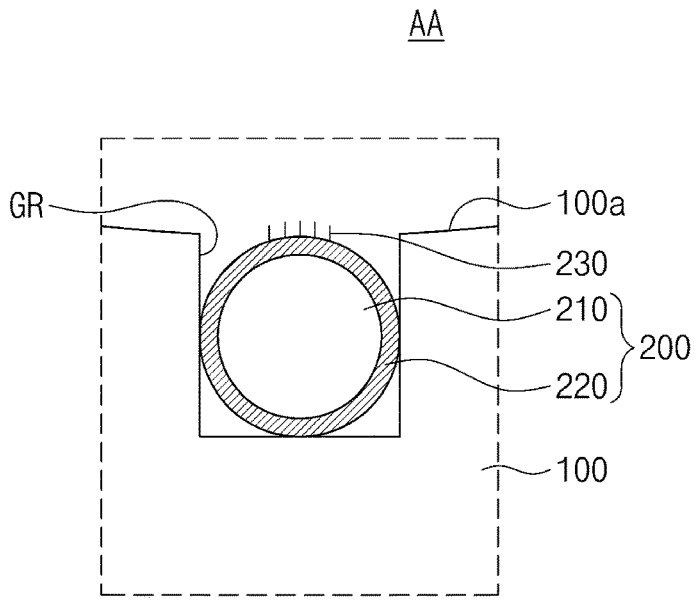
FIGS. 8A and 8B are enlarged cross-sectional views of a portion AA of FIG. 3.
Figure 8B:
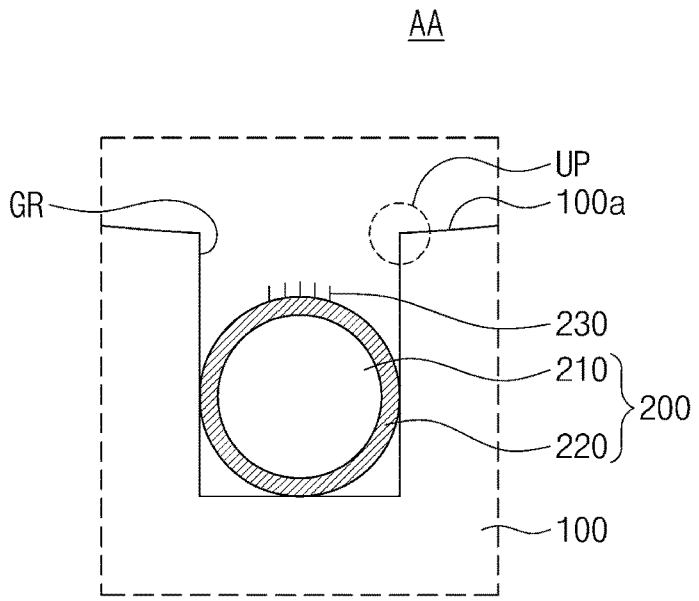

FIGS. 8A and 8B are enlarged cross-sectional views of a portion AA of FIG. 3.

Referring to FIG. 8A, a depth of the groove GR may be equal to a thickness or diameter of the emitter structure 200. The ends 230 of the conductive strings may protrude toward the target 300 and be disposed at vertical levels that are the same as or higher than the first face 100*a* of the cathode electrode 100.

Referring to FIG. 8B, a depth of the groove GR may be greater than a thickness or diameter of the emitter structure 200. The ends 230 of the strings may be disposed at vertical levels lower than the first surface 100*a* of the cathode electrode 100. That is, the ends 230 may be disposed at levels lower than the uppermost portion of an inner wall of the groove GR. As a result, a portion of the electron beam emitted from the ends 230 of the strings may be blocked by an upper portion UP of the inner surface of the groove GR, and a focusing speed of the electron beam may be improved.

Figure 9:
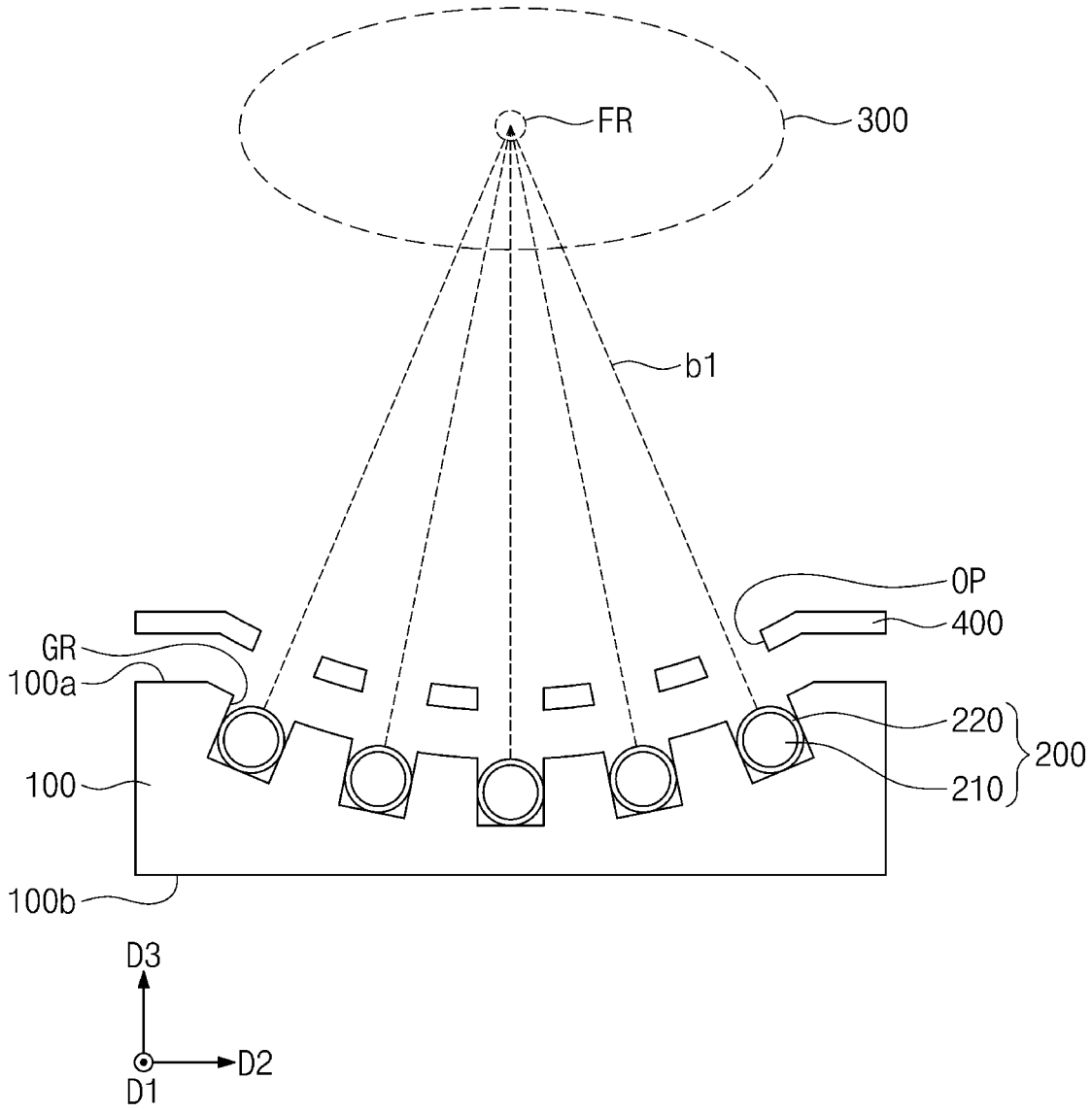
FIG. 9 is a cross-sectional view of the field emission device according to embodiment of the inventive concept.
Figure 10:
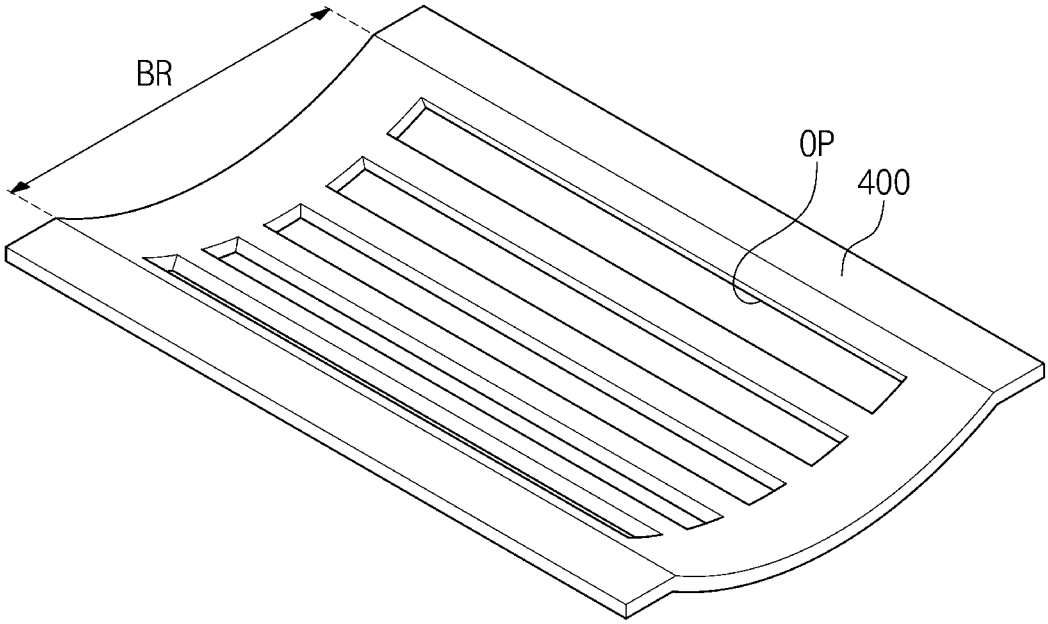
FIG. 10 is a perspective view of a gate electrode according to embodiment of the inventive concept.

FIG. 9 is a cross-sectional view of the field emission device according to embodiment of the inventive concept. FIG. 10 is a perspective view of a gate electrode according to embodiment of the inventive concept.

Referring to FIGS. 9 and 10, the gate structure 400 may have a plate shape. The gate structure 400 may include a recess part BR that is curved toward the cathode electrode 100. A plurality of openings OP passing through the gate structure 400 may be defined in the recess part BR. The openings OP may overlap the emitter structures 200, respectively. The electron beam b1 emitted from the emitter structures 200 may be focused in the focus region FR of the target 300 through the openings OP.

FIGS. 11 to 14 are schematic perspective views for explaining a method for manufacturing an emitter structure according to embodiments of the inventive concept.

Figure 11:
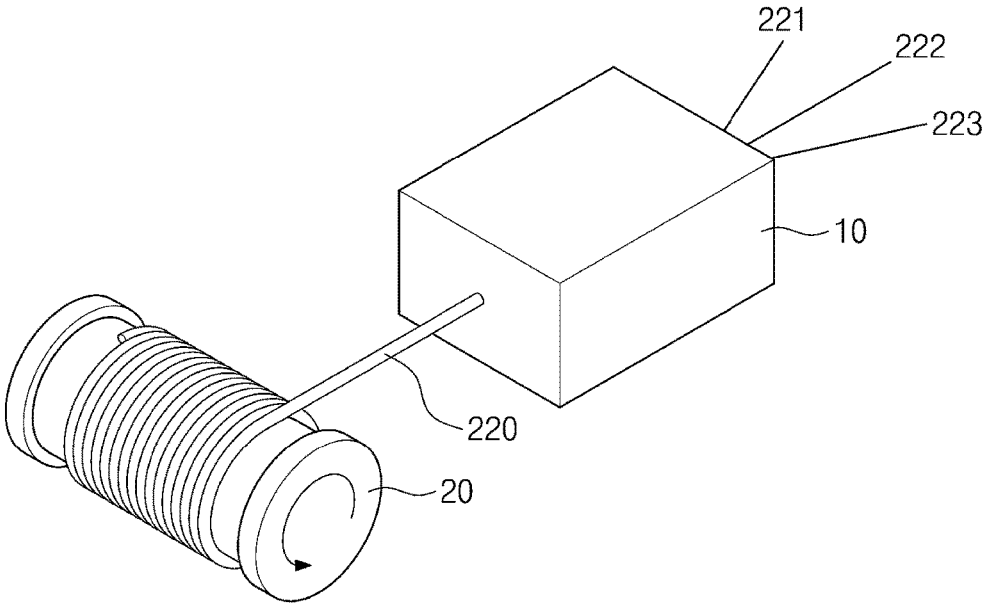
FIGS. 11 to 14 are schematic perspective views for explaining a method for manufacturing an emitter structure according to embodiments of the inventive concept.

Referring to FIG. 11, a conductive wire 220 according to embodiments of the present invention is manufactured. The conductive wire 220 may be formed using strings 221, 222, and 223 and a braiding unit 10. The strings 221, 222, and 223 may be combined by the braiding unit 10. Each of the strings 221, 222, and 223 may include a carbon nanotube. The conductive wire 220 formed by the braiding unit 10 may be wound around a bobbin 20.

Figure 12:
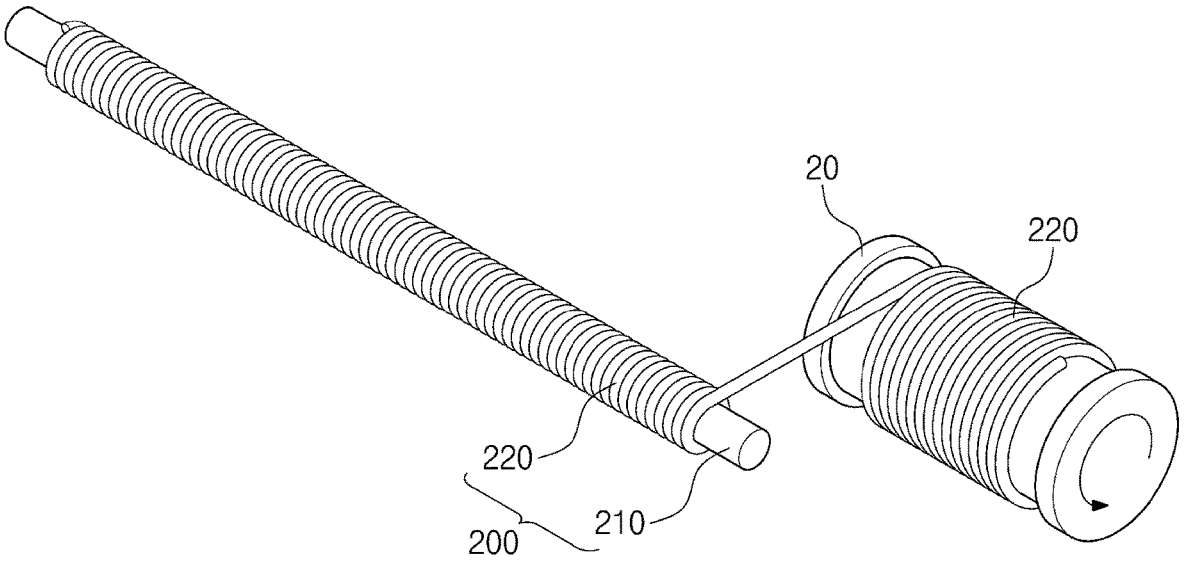

Referring to FIG. 12, the conductive wire 220 wound around the bobbin 20 may be wound around the core 210. The conductive wire 220 may be spirally wound along an outer circumferential surface of the core 210.

Figure 13:
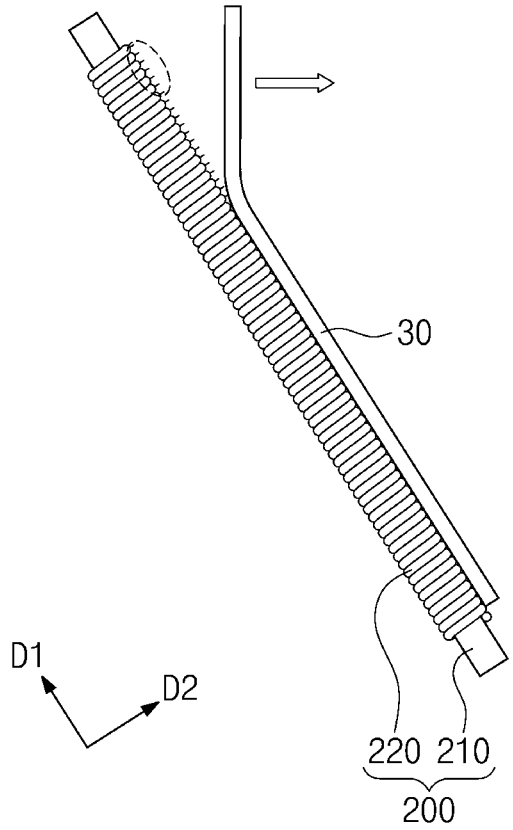

Referring to FIG. 13, after allowing an adhesive sheet 30 to adhere to the conductive wire 220, the adhesive sheet 30 may be detached so that the ends 230 of the strings protrude. Specifically, the plurality of strings constituting the conductive wire 220 may be broken by adhesive force of the adhesive sheet 30 to have a plurality of ends 230. The ends 230 may be formed at a portion of a surface of the conductive wire 220 to which the adhesive sheet 30 is attached. The end 230 may not be formed in another area of the surface of the conductive wire 220 to which the adhesive sheet 30 is not attached. The ends 230 may extend in a direction parallel to a direction in which the adhesive sheet 30 is detached.

Figure 14:
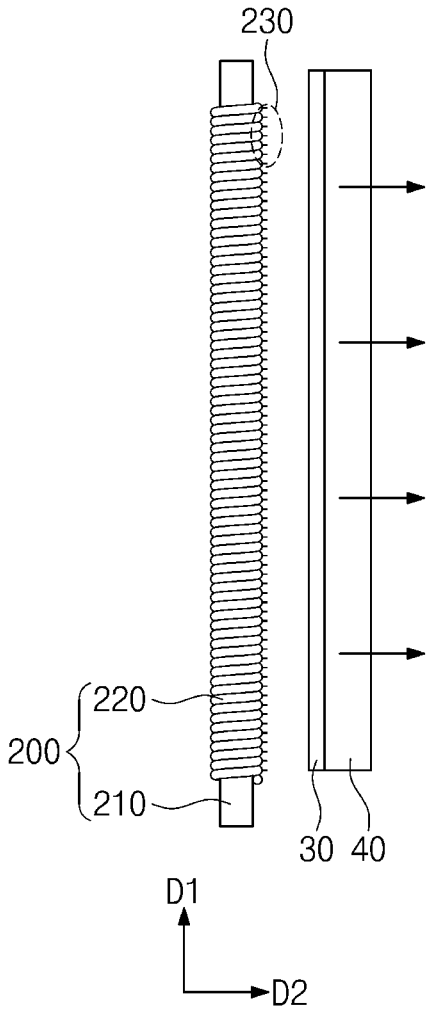

According to embodiments, as illustrated in FIG. 14, the adhesive sheet 30 may be provided in a state of being attached on one surface of a support member 40. The support member 40 may be attached to the adhesive sheet 30 and maintained so as not to be bent while being detached from the conductive wire 220. The adhesive sheet 30 may be delaminated in a second direction D2 perpendicular to a first direction D1 in which the core 210 extends. As a result, the ends 230 of the strings may extend in a direction parallel to the second direction D2.

According to the embodiments of the inventive concept, the field emission device, which is easy to be manufactured and has the excellent durability, may be provided.

Although the embodiment of the inventive concept is described with reference to the accompanying drawings, those with ordinary skill in the technical field of the inventive concept pertains will be understood that the present disclosure can be carried out in other specific forms without changing the technical idea or essential features. Thus, the above-disclosed embodiments are to be considered illustrative and not restrictive.

What is claimed is:

1. A field emission device comprises:

a cathode electrode having a first surface and a second surface facing the first surface, the cathode electrode comprising grooves that are recessed from the first surface toward the second surface, the grooves extending in a first direction parallel to the first surface; and emitter structures which are disposed within the grooves and each of which comprises a core extending in the first direction and a conductive wire configured to surround the core, wherein the grooves are arranged in a second direction crossing the first direction, and the emitter structures are disposed at vertical levels different from each other.

2. The field emission device of claim 1, wherein the first surface of the cathode electrode comprises a concave region that is recessed toward the second surface, and the grooves are defined in the concave region.

3. The field emission device of claim 2, wherein the concave region has a constant height along the first direction.

4. The field emission device of claim 1, wherein the grooves comprise a first groove and a second groove spaced apart from each other in a second direction perpendicular to the first direction, a bottom surface of the first groove is inclined with respect to a bottom surface of the second groove.

5. The field emission device of claim 1, wherein each of the emitter structures has a diameter less than a depth of each of the grooves.

6. The field emission device of claim 1, further comprising a target comprising a third surface facing the first surface and inclined with respect to the first surface.

7. The field emission device of claim 6, wherein the third surface is parallel to the second direction.

8. The field emission device of claim 1, wherein the conductive wire comprises a plurality of strings, and the strings have ends protruding in a direction that is away from the second surface.

9. The field emission device of claim 8, wherein the ends of the strings extend in a direction perpendicular to the first direction.

10. The field emission device of claim 1, wherein the conductive wire comprises a plurality of strings coupled to each other.

11. The field emission device of claim 1, wherein the conductive wire comprises a carbon nanotube.

12. The field emission device of claim 1, further comprising a target on the first surface and a gate structure between the cathode electrode and the target, wherein the gate structure comprises a plurality of conductive rods extending in the first direction.

13. A field emission device comprises:

a cathode electrode having a first surface and a second surface facing the first surface, the cathode electrode comprising grooves that are recessed from the first surface toward the second surface, wherein the grooves extend in a first direction;

an emitter structure disposed within each of the grooves; and a target comprising a third surface facing the first surface, wherein the emitter structure comprises a core extending in the first direction and a conductive wire configured to surround the core, and the conductive wire comprise strings having ends protruding toward the target.

14. The field emission device of claim 13, wherein the strings comprise carbon nanotubes.

15. The field emission device of claim 13, wherein each of the ends is disposed at a level lower than the uppermost portion of an inner wall of each of the grooves.

16. The field emission device of claim 13, wherein the ends of the strings extend in a second direction perpendicular to the first direction.

17. The field emission device of claim 13, further comprising a gate structure disposed between the target and the cathode electrode and having an opening extending in the first direction.

* * * * *